US008311465B2

(12) United States Patent
Nomura et al.

(10) Patent No.: US 8,311,465 B2
(45) Date of Patent: Nov. 13, 2012

(54) IMAGE FORMING APPARATUS AND TRANSFER APPARATUS

(75) Inventors: Yujiro Nomura, Nagano (JP); Yoshihisa Saka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 295 days.

(21) Appl. No.: 12/854,419

(22) Filed: Aug. 11, 2010

(65) Prior Publication Data

US 2011/0044731 A1 Feb. 24, 2011

(30) Foreign Application Priority Data

Aug. 21, 2009 (JP) ..... 2009-192180

(51) Int. Cl.
*G03G 15/01* (2006.01)

(52) U.S. Cl. ..... 399/302; 399/308

(58) Field of Classification Search ..... 399/116, 399/121, 297, 302–304, 308
See application file for complete search history.

(56) References Cited

U.S. PATENT DOCUMENTS 6,163,676 A 12/2000 Levanon et al.
7,558,508 B2 * 7/2009 Yamazaki et al. ..... 399/162
2007/0134028 A1 * 6/2007 Funabashi ..... 399/299
2008/0213010 A1 * 9/2008 Oyama et al. ..... 399/313

FOREIGN PATENT DOCUMENTS

JP 2000-508280 A 7/2000
JP 2008-122815 A 5/2008
WO WO-97/09262 A 3/1997

* cited by examiner

*Primary Examiner* — Hoan Tran
(74) *Attorney, Agent, or Firm* — Global IP Counselors, LLP

(57) ABSTRACT

An image forming apparatus including: an image carrier that has a belt-like shape and carries an image; an image forming section that forms the image on the image carrier; a driving roller around which the image carrier is looped, the driving roller being rotationally driven by a first driving source to drive the image carrier; a roller around which the image carrier is looped; a transfer roller having a partially hollow peripheral surface and being rotationally driven by a second driving source, the transfer roller abutting on the image carrier to form a transfer nip at a position at which the image carrier is looped around the roller; a first tension roller that abuts on the image carrier between a position of the driving roller and a position of the roller to adjust a tensile force of the image carrier; and a second tension roller that abuts on the image carrier to adjust a tensile force of the image carrier, the second tension roller abutting on the image carrier on an abutting position opposite to that of the first tension roller so as to interpose the transfer nip between the first and second tension rollers.

8 Claims, 10 Drawing Sheets

RECORDING MATERIAL TRANSPORT START

PAPER PINCH OPERATION START

PAPER PINCH OPERATION FINISH

SECONDARY TRANSFER START

UNDER SECONDARY TRANSFER

RECORDING MATERIAL RELEASE

IMAGE FORMING APPARATUS AND TRANSFER APPARATUS

BACKGROUND

1. Technical Field

The present invention relates to an image forming apparatus and image transfer apparatus including a belt-shaped image carrier that carries an image and including a transfer roller that has a partially hollow peripheral surface and that abuts on the image carrier to form a nip.

2. Related Art

In some image forming techniques by which an image is formed on a recording material such as paper, the image is temporarily formed on a belt-shaped image carrier and then is transferred to the recording material. For example, in an image forming apparatus disclosed in JP-A-2008-122815 (specifically disclosed in FIG. 1), an image forming station forms an image on a transfer belt as an image carrier that is looped around a plurality of rollers. The transfer belt and a secondary transfer roller abut on each other to form a transfer nip. A recording material is transported through the transfer nip, thereby transferring the image from the transfer belt to the recording material.

Preferably, in order for the image to be transferred from the image carrier to the recording material at a high transfer efficiency, a large pressing force is applied to the transfer material that passes the transfer nip. On the other hand, application of a large pressing force causes a disadvantage that the recording material adheres to the image carrier. For example, the image forming apparatus disclosed in JP-A-2008-122815 employs liquid development, and an electrostatic latent image is developed with a liquid carrier in which a developer is dispersed. The liquid carrier is likely to remain, resulting in the adherence of the recording material.

In order to resolve such a problem, for example, employment of a technique disclosed in JP-A-2000-508280 (specifically disclosed in FIG. 2A) is considered. An image forming apparatus disclosed in JP-A-2000-508280 is provided with an openable gripper as a gripping member at part of a peripheral surface of a cylindrical pressing roller (corresponding to a transfer roller). The gripper grips an end of a recording material, and therefore the recording material is prevented from adhering to an intermediate transfer member that abuts on the pressing roller. The intermediate transfer member, which is an image carrier in the image forming apparatus disclosed in JP-A-2000-508280, is a rotator in the form of a roller.

In terms of the combination of the techniques disclosed in JP-A-2008-122815 and JP-A-2000-508280, the following disadvantage is caused. Namely, because the pressing roller disclosed in JP-A-2000-508280 is provided with the gripping member, the peripheral surface thereof is not a smooth cylindrical surface, and therefore the pressing force at the transfer nip is varied in conjunction with a rotational period of the roller. Such a variation causes a speed variation of the belt-shaped image carrier that abuts on the roller. Consequently, an image which is formed on the image carrier by the image forming station becomes distorted.

Such a problem commonly occurs in cases where a transfer roller having a peripheral surface that is not completely cylindrical is used. For example, in cases where a transfer roller having such a shape that a cylindrical peripheral surface is partially hollow is used, such a problem may occur. Namely, the pressing force applied to a surface of the image carrier is significantly different between a case where the image carrier faces and abuts on the cylindrical peripheral surface of the transfer roller and a case where the image carrier faces the hollow portion of the transfer roller and is spaced apart from the transfer roller. Consequently, a significant speed variation is caused at the time that each of the cases is switched. Especially, such a problem significantly occurs in cases where a transfer roller including a hollow portion having a size larger than a width of the transfer nip is used.

SUMMARY

An advantage of some aspects of the invention is that it provides an image forming apparatus and transfer apparatus including a belt-shaped image carrier and a transfer roller having a partially hollow peripheral surface, thereby being able to suppress a variation in the speed of an image carrier to prevent an image from becoming distorted resulting from the speed variation.

According to an aspect of the invention, in order to overcome disadvantages in the related art, there is provided an image forming apparatus including: an image carrier that has a belt-like shape and carries an image; an image forming section that forms the image on the image carrier; a driving roller around which the image carrier is looped, the driving roller being rotationally driven by a first driving source to drive the image carrier; a roller around which the image carrier is looped; a transfer roller having a partially hollow peripheral surface and being rotationally driven by a second driving source, the transfer roller abutting on the image carrier to form a transfer nip at a position at which the image carrier is looped around the roller; a first tension roller that abuts on the image carrier between a position of the driving roller and a position of the roller to adjust a tensile force of the image carrier; and a second tension roller that abuts on the image carrier to adjust a tensile force of the image carrier, the second tension roller abutting on the image carrier on an abutting position opposite to that of the first tension roller so as to interpose the transfer nip between the first and second tension rollers.

According to another aspect of the invention, in order to overcome disadvantages in the related art, there is provided a transfer apparatus including: a transfer belt to which an image is transferred; a driving roller around which the transfer belt is looped, the driving roller being rotationally driven by a first driving source; a roller around which the transfer belt is looped; a transfer roller having a partially hollow cylindrical peripheral surface and being rotationally driven by a second driving source, the transfer roller abutting on the transfer belt to form a transfer nip at a position at which the transfer belt is looped around the roller; a first tension roller that abuts on the transfer belt between a position of the driving roller and a position of the roller to adjust a tensile force of the transfer belt; and a second tension roller that abuts on the transfer belt to adjust a tensile force of the transfer belt, the second tension roller abutting on the transfer belt on an abutting position opposite to that of the first tension roller so as to interpose the transfer nip between the first and second tension rollers.

In the invention having the above advantages, the first and the second tension rollers that adjust a tensile force of the belt-shaped image carrier (or the transfer belt, similarly hereinafter) are configured so as to each abut on the image carrier with interposing the transfer nip therebetween, the image carrier abutting on the transfer roller to form the transfer nip. Because the transfer roller has a hollow portion on the peripheral surface thereof, a pressing force applied to the image carrier is significantly varied between the case the hollow portion faces the image carrier and the case where the hollow portion does not face the same. The image carrier is driven in a predetermined direction by the driving roller that is rotationally driven by the first driving source, whereas the transfer roller is rotationally driven by the second driving source. Furthermore, the driving roller that serves to drive the image carrier is separated from the roller that faces the transfer roller.

Although the image carrier abuts on the transfer roller to generate the speed variation thereof, the first and second tension rollers between which the transfer nip is interposed absorb the speed variation of the image carrier by virtue of these advantages. Accordingly, although the speed variation is transmitted to, viewed from the transfer nip, sides distant from portions in which the first and second tension rollers abut on the image carrier, such a speed variation is moderated on the image carrier. The driving roller drives the image carrier in a region distant from the abutting portions of the tension rollers, and therefore the speed variation of the image carrier in such a region is capable of being more certainly suppressed. Consequently, according to an aspect of the invention, a distorted image resulting from the speed variation of the image carrier is capable of being efficiently suppressed.

It is preferable that the first tension roller and the second tension roller abut on a surface of the image carrier, the surface being opposite to a surface on which the image is carried. By virtue of this advantage, the image carried by the image carrier is prevented from contacting with the first and second tension rollers, leading to producing a non-distorted image.

Preferably, the image forming section forms the image on the image carrier, and then the driving roller drives the image carrier, and subsequently the transfer nip is formed on the driven image carrier. In other words, preferably, an image forming position in which the image forming section forms the image, a position in which the driving roller drives the image carrier, and a position of the transfer nip are located in sequence in a direction in which the image carrier is driven. Accordingly, even though causes by which the speed of the image carrier is distorted are generated at the transfer nip, the driving force applied to the driving roller is capable of suppressing the speed variation. Because the image carrier that passes the image forming position is exposed to constant tension by the rotation of the driving roller, a distorted image resulting from the loose image carrier in the image forming position is capable of being prevented. Preferably, the driving roller abuts on the image carrier in the upstream side relative to the winding position of the first tension roller. Owing to such a configuration, the first tension roller is disposed between the transfer nip and the driving roller so as to separate a distance therebetween, and therefore the advantage in which the speed variation is suppressed is capable of being more enhanced. In cases where a plurality of the image forming sections are disposed in a direction in which the image carrier is driven, the driving roller is preferably disposed in the downstream side with respect to image forming positions of the respective image forming sections.

It is preferable that a second image forming section may be provided, the second image forming section further forming an image on the image carrier having the image that has been formed in the image forming section. Furthermore, it is preferable that a length of the image carrier from the transfer nip to a position in which the image forming section forms an image on the image carrier may be configured to be larger than a length of the image carrier from a position in which the second image forming section forms an image on the image carrier to the transfer nip in a direction in which the image carrier is driven.

According to this configuration, the second image forming section is disposed in the downstream side relative to the image forming section in a direction in which the image carrier is driven. Because the driving roller is disposed between the second image forming section and the transfer nip in the upstream side relative to the transfer nip in a direction the image carrier is driven, the driving roller serves to suppress the effect of the speed variation at the transfer nip on the image forming section. On the other hand, although a suppressive effect by the driving roller is decreased in the downstream side relative to the transfer nip, the effect of the speed variation on the image forming position of the image forming section is capable of being suppressed by absorbing the speed variation owing to flexibility and elasticity of the belt-shaped image carrier by increasing a length of the belt to the image forming position.

The same is applied to even the case where only a pair of the image forming sections are formed. Namely, it is preferable that a length of the image carrier between the image forming position of the image forming section and the transfer nip is configured to be larger in the downstream side relative to the transfer nip as compared with the upstream side in a direction in which the image carrier is driven.

In this case, it is preferable that the first tension roller is supported by a first spring having a spring constant k1, and the second tension roller is supported by a second spring having a spring constant k2. Furthermore, provided that an angle at which the image carrier is looped around the first tension roller, namely the central angle of a cylindrical surface which is a peripheral surface of the tension roller around which the image carrier is looped, is defined as θ1 and that an angle at which the image carrier is looped around the second tension roller is defined as θ2, a relationships represented by a formula:

$$k1/\sin(\theta 1/2)<k2/\sin(\theta 2/2)$$

may be obtained.

The first and second tension rollers themselves, supported by the springs, vibrate to absorb the speed variation generated at the transfer nip. The spring constant is preferably configured to be large in order to swiftly converge the vibration, whereas the spring constant is preferably small in terms of the effect of absorbing the speed vibration, and both requirements conflict. A configuration in which the requirements are both satisfied is employed, so that the speed variation of the image carrier is capable of being absorbed, and the vibration of the tension rollers themselves is also capable of being swiftly converged. Details of this advantage will be described hereinafter.

Furthermore, in the image forming apparatus and transfer apparatus having the above configurations, it is preferable that an elastic layer is provided on the peripheral surface of the transfer roller. Accordingly, a large pressing force is capable of being evenly applied to the recording material that passes the transfer nip, so that an image is efficiently transferred from the image carrier to the recording material. Especially, in cases where a sheet-like elastic body is looped around a surface of the transfer roller to achieve the above configuration, an end of the sheet-like elastic body is required to be processed. An advantage of the invention enables the hollow portion to be formed on the transfer roller without generating the speed variation of the image carrier, thereby performing end treatment.

Furthermore, it is preferable that a gripper may be provided on the peripheral surface of the transfer roller at the hollow portion, the gripper being configured to grip a recording material to which an image is transferred. Such a gripper is provided, and therefore the adherence of the recording material to the image carrier is capable of being certainly prevented at the transfer nip. By virtue of this advantage, a speed variation of the image carrier due to forming the hollow portion on the transfer roller is precluded. Accordingly, the gripper is accommodated in the hollow portion, and therefore the distorted image resulting from the speed variation and the adherence of the recording material to the image carrier are capable of being efficiently precluded, thereby efficiently forming an image of good quality on the recording material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
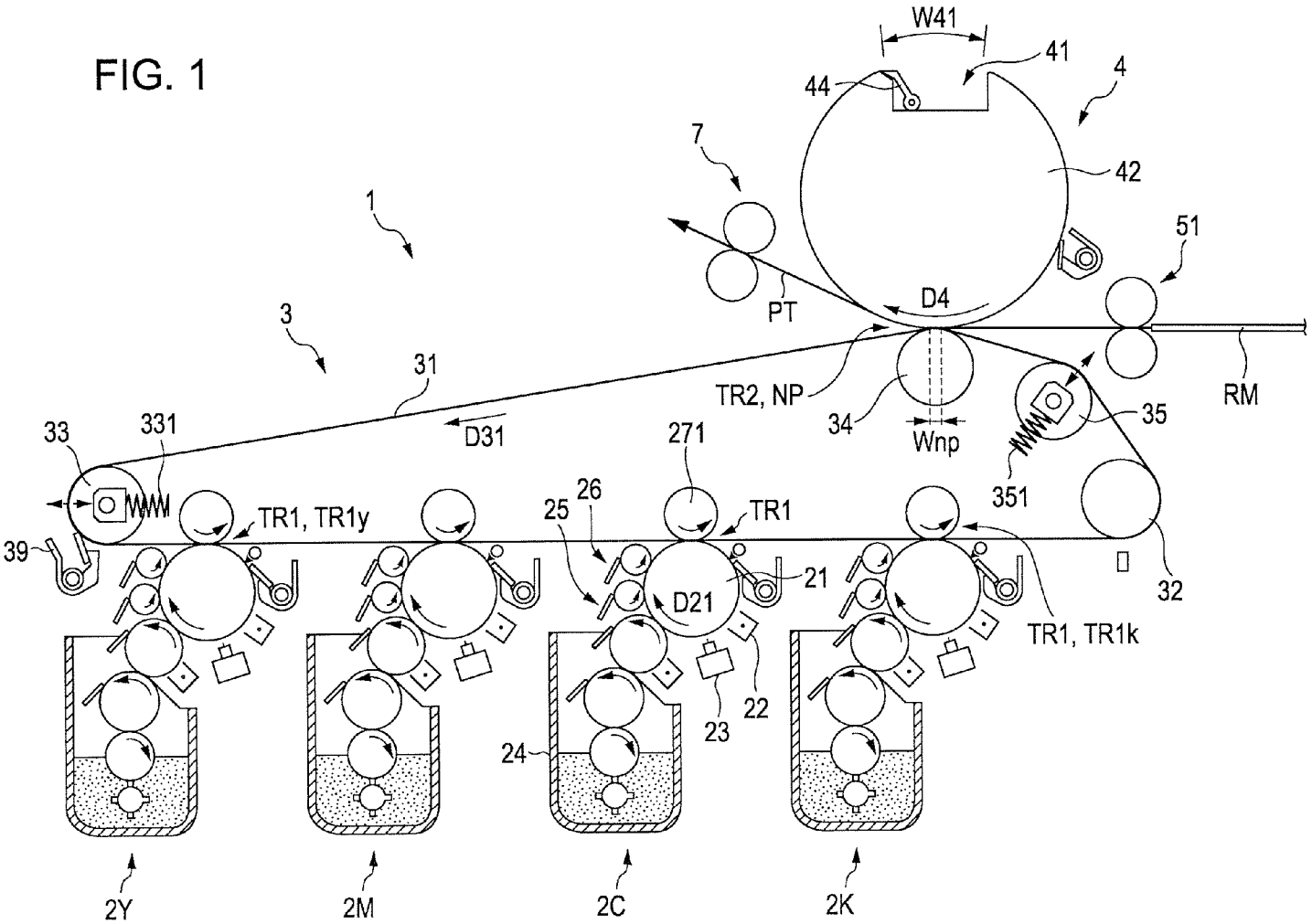
FIG. 1 illustrates an image forming apparatus according to a first embodiment of the invention.
Figure 2:
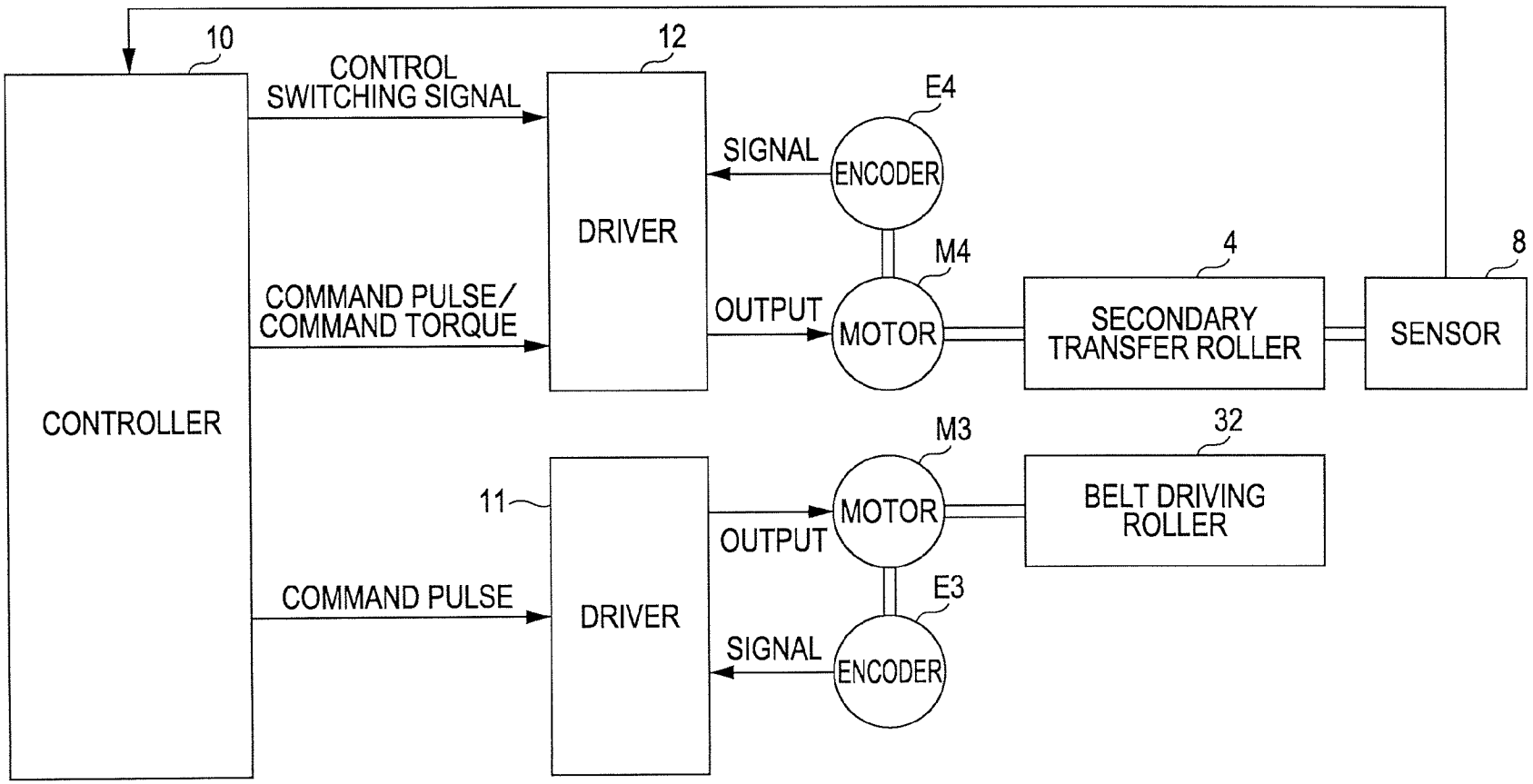
FIG. 2 is a block diagram illustrating the electrical configuration of the apparatus illustrated in FIG. 1.

FIG. 1 illustrates an image forming apparatus 1 according to a first embodiment of the invention. FIG. 2 is a block diagram illustrating the electrical configuration of the image forming apparatus 1 illustrated in FIG. 1. The image forming apparatus 1 is provided with four image forming stations including 2Y (for yellow), 2M (for magenta), 2C (for cyan), and 2K (for black), each station forming an image of different colors. Toners of four colors including yellow (Y), magenta (M), cyan (C), and black (K) are used in combination to form a color image, and only a toner of black (K) is used to form a black-and-white image. The image forming apparatus 1 is capable of selectively performing the color print and the black-and-white print. In this image forming apparatus, in cases where a controller 10 having a central processing unit (CPU) and a memory receives an image forming instruction from an external apparatus such as a host computer, the controller 10 controls each section of the image forming apparatus to perform a predetermined image forming operation, thereby forming an image corresponding to the image forming instruction on a sheet-like recording material RM including, for example, a copy sheet, a transfer sheet, paper, a transparent sheet for an overhead projector (OHP).

Each of the image forming stations 2Y, 2M, 2C, and 2K has the same configuration and function, the only difference between them being the color of the toner. Therefore, for the purpose of visually simplifying FIG. 1, only components included in the image forming station 2C are denoted by reference numerals and notes, and reference numerals and notes to be assigned to the other image forming stations 2Y, 2M, and 2K are omitted. The configuration and operation of the image forming station 2C will be hereinafter described with reference to the numerals assigned in FIG. 1, and the configurations and operation of the other image forming stations 2Y, 2M, and 2K are the same as those of the image forming station 2C except that the toner colors are different.

The image forming station 2C has a photoconductive drum 21 of which a cyan toner image is formed on a surface. The photoconductive drum 21 is disposed such that the rotating shaft thereof is positioned parallel with or substantially parallel with a main scanning direction (direction normal to the page in FIG. 1). The photoconductive drum 21 is rotationally driven at a predetermined speed in a direction indicated by an arrow D21 in FIG. 1.

Several components including: a charger 22 as a corona charger that charges a surface of the photoconductive drum 21 to a predetermined electric potential; an exposure unit 23 that exposes the surface of the photoconductive drum 21 on the basis of an image signal to form an electrostatic latent image; a developing unit 24 that develops the electrostatic latent image as a toner image; a first squeeze section 25; a second squeeze section 26; a primary transfer unit that primarily transfers the toner image to an intermediate transfer belt 31 of a transfer unit 3; a cleaning unit that cleans the surface of the photoconductive drum 21 after the transfer; and a cleaner blade are disposed around the photoconductive drum 21 in sequence in the rotational direction D21 (clockwise in FIG. 1) of the photoconductive drum 21.

The charger 22 is not in contact with a surface of the photoconductor drum 21. A typical corona charger is capable of being used as the charger 22. In cases where a scorotron charger is used as the corona charger, a negative wire current flows in a charge wire of the scorotron charger, and a grid charging bias as a direct current (DC) voltage is applied to a grid. The photoconductive drum 21 is charged by the corona discharge of the charger 22 with the result that an electric potential on a surface of the photoconductive drum 21 is configured so as to be substantially uniform.

The exposure unit 23 exposes a surface of the photoconductive drum 21 by a light beam on the basis of an externally provided image signal to form an electrostatic latent image corresponding to the image signal. The exposure unit 23 may be configured by a technique in which a light beam from a semiconductor laser is scanned with a polygon mirror in a main scanning direction or may be configured by a line head in which light emitting devices are disposed in the main scanning direction.

A toner is applied from the developing unit 24 to the formed electrostatic latent image, thereby the electrostatic latent image is developed with the toner. In the developing unit 24 of the image forming apparatus 1, developer in which toners are dispersed to approximately 20% by weight into a carrier liquid is used to perform the toner development. The liquid developer used in the embodiment is not a typical volatile liquid developer that volatilizes at room temperature, that has a low carrier concentration (about 1 to 2 wt %) and a low viscosity, and that contains Isopar (trademark: available from Exxon) as a carrier liquid. A high concentration and high viscosity liquid developer that is non-volatile at room temperature is used. More specifically, the liquid developer to be used in the embodiment has a high viscosity (approximately 30 to 10000 mPa·s) liquid developer prepared by adding solid particles to a liquid solvent selected from an organic solvent, silicon oil, mineral oil and edible oil with a dispersant so as to make the concentration of toner solid equal to about 20%, the solid particles having an average particle size of 1 μm and being formed by dispersing a coloring agent such as a pigment into thermoplastic resin.

Each of the first squeeze section 25 and the second squeeze section 26 includes a squeeze roller. Each of the squeeze rollers abuts on a surface of the photoconductive drum 21 to remove a surplus carrier liquid and fogging toner of the toner image. Although the two squeeze sections 25 and 26 remove the surplus carrier liquid and the fogging toner in the embodiment, the number and the arrangement of the squeeze section are not limited to such a configuration. For example, a single squeeze section may be disposed.

The toner image that has passed the squeeze sections 25 and 26 is primarily transferred to the intermediate transfer belt 31 by the primary transfer unit. The intermediate transfer belt 31 is an endless belt that functions as an image carrier and that is capable of temporarily carrying a toner image on a surface, more specifically, on an outer surface of the belt. The intermediate transfer belt 31 is looped around a plurality of rollers 32, 33, 34, and 35. Among these rollers, the roller 32 is mechanically connected to a belt driving motor M3 to function as a belt driving roller, thereby driving the intermediate transfer belt 31 such that the intermediate transfer belt 31 goes around the rollers in a direction indicated by an arrow D31 in FIG. 1. With reference to FIG. 2, a driver 11 is provided in the embodiment in order to drive the belt driving motor M3. The controller 10 transmits a command pulse to the driver 11, and the driver 11 outputs a driving signal based on the command pulse to the belt driving motor M3. Accordingly, the belt driving roller 32 is rotated at a rotational speed depending on the command pulse, and a surface of the intermediate transfer belt 31 circulates at a constant speed in the direction D31. The symbol E3 in FIG. 2 denotes an encoder fixed to the belt driving motor M3. The encoder E3 transmits a signal corresponding to the rotation of the belt driving motor M3 to the driver 11, and the driver 11 that has received the signal performs feedback control of the belt driving motor M3 on the basis of the signal.

Among the rollers 32 to 35 around which the intermediate transfer belt 31 is looped, only the belt driving roller 32 is driven by the motor as described above, and the other rollers 33 to 35 are driven rollers not having driving sources. This configuration will be described in detail hereinafter.

The primary transfer unit has a primary transfer backup roller 271. The primary transfer backup roller 271 is disposed so as to face the photoconductive drum 21 with the intermediate transfer belt 31 disposed therebetween. In a primary transfer position TR1 in which the photoconductive drum 21 abuts on the intermediate transfer belt 31, a toner image on the photoconductive drum 21 is transferred onto an outer surface (a lower surface in the transfer position TR1) of the intermediate transfer belt 31. The cyan toner image formed by the image forming station 2C is transferred to the intermediate transfer belt 31 in this manner. Similarly, toner images are transferred also in the other image forming stations 2Y, 2M, and 2K, and therefore the toner image of each color is applied to the intermediate transfer belt 31 in series, thereby forming a full-color toner image. On the other hand, in cases where a black-and-white toner image is formed, the toner image is transferred to the intermediate transfer belt 31 only in the image forming station 2K corresponding to the color of black.

The toner image transferred to the intermediate transfer belt 31 in this manner is transported to a secondary transfer position TR2. A secondary transfer roller 4 is disposed in the secondary transfer position TR2 so as to face the roller 34 around which the intermediate transfer belt 31 is looped while interposing the intermediate transfer belt 31 therebetween. A surface of the intermediate transfer belt 31 and a surface of the secondary transfer roller 4 abut on each other to form a transfer nip. Namely, the roller 34 functions as a secondary backup transfer roller.

The toner image formed on the intermediate transfer belt 31 in a single color or multiple colors is transferred to the recording material RM in the secondary transfer position TR2, the recording material RM being transported from a pair of gate rollers 51 through a transport path PT. In the embodiment, because the toner image is formed by a wet developing technique using liquid developer, the recording material RM is desirably pressed against the intermediate transfer belt 31 with a high pressing force at the transfer nip in order to obtain good transfer properties. Due to usage of the liquid developer, the recording material RM is more likely to adhere to the intermediate transfer belt 31, resulting in the occurrence of paper jam. Accordingly, the secondary transfer roller 4 used in the embodiment has a gripper which will be described hereinafter.

The recording material RM, to which the toner image is secondarily transferred, is transported from the secondary transfer roller 4 to a fixing unit (not illustrated) by a transport roller 7 disposed in the transport path PT. The fixing unit applies heat and pressure to the toner image transferred to the recording material RM to fix the toner image to the recording material RM.

Figure 3:
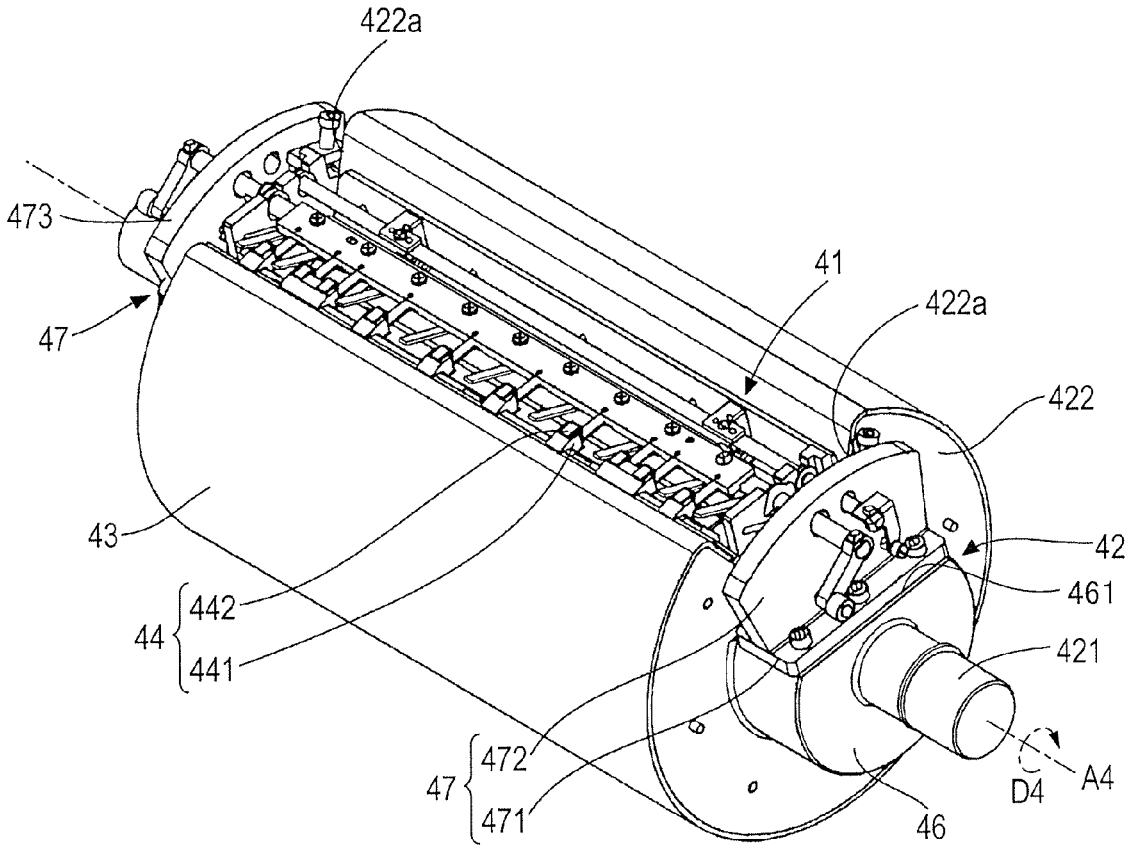
FIG. 3 is a perspective view illustrating the general configuration of a secondary transfer roller.

FIG. 3 is a perspective view illustrating a general configuration of the secondary transfer roller 4. With reference to FIGS. 1 and 3, the secondary transfer roller 4 includes a roller base 42 having a hollow 41 which is formed by partially cutting out a cylindrical peripheral surface thereof. In the roller base 42, a rotating shaft 421 is provided so as to be parallel with or substantially parallel with a rotating shaft of the secondary transfer backup roller 34, the rotating shaft 421 being able to rotate around a rotational axis A4 in a direction D4. Two side plates 422 are individually fixed to the two ends of the rotating shaft 421. More specifically, each of the side plates 422 has a cutout portion 422*a* which is formed by cutting out a disc-shaped metal plate. Each of the side plates 422 is fixed to the rotating shaft 421 such that the cutout portions 422*a* face each other as illustrated in FIG. 3 and such that a distance that is slightly larger than the width of the intermediate transfer belt 31 is interposed between the cutout portions 422*a*. The roller base 42 is formed in this manner, and such a roller base 42 is in the form of a drum as a whole but partially has the hollow 41 extending parallel with or substantially parallel with the rotating shaft 421 on a peripheral surface thereof.

An elastic layer 43 is formed on a peripheral surface, more specifically a surface region except a portion corresponding to the inside of the hollow 41, of the roller base 42 with rubber or a resin. The elastic layer 43 faces the intermediate transfer belt 31 looped around the driving roller 32 to form a transfer nip NP.

A gripper 44 is disposed inside the hollow 41 to grip the recording material RM. The gripper 44 has a gripping support member 441 and the gripping member 442, the gripping support member 441 extending from the inside bottom of the hollow 41 so as to be vertically arranged on a peripheral surface of the roller base 42, the gripping member 442 being supported so as to be able to contact with and separate from the leading end of the gripping support member 441. The gripping member 442 is connected to a gripper driving section (not illustrated). The gripper driving section operates in response to a non-gripping command output from the controller 10 and causes the leading end of the gripping member 442 to separate from the leading end of the gripping support member 441 in order to release the grip on the recording material RM or in order to prepare the grip on the recording material RM. The gripper driving section operates in response to a gripping command output from the controller 10 and causes the leading end of the gripping member 442 to move toward the leading end of the gripping support member 441 in order to grip the recording material RM. The configuration of the gripper 44 is not limited to the embodiment, and a typical gripping mechanism, for example, that disclosed in JP-A-2000-508280 may be employed.

In the two ends of the secondary transfer roller 4, a supporting member 46 is provided on an outer surface of each of the side plates 422. The supporting members 46 are capable of being integrally rotated with the roller base 42. Each of the supporting members 46 has a planar region 461 corresponding to the hollow 41. A transfer roller abutment member 47 is disposed on each of the planar regions 461. The abutment member 47 includes a base portion 471 fixed to the supporting member 46 and includes an abutment portion 472 extending from the base portion 471 in a normal direction of the planar region 461, the abutment portion 472 having a leading end that reaches the vicinity of a side end of the opening of the hollow 41. Namely, viewing the roller base 42 from an end of the rotating shaft 421, the abutment members 47 are positioned so as to cover the hollow 41. Accordingly, in cases where the secondary transfer roller 4 is rotated with the result that the hollow 41 is positioned so as to face the intermediate transfer belt 31, the abutment members 47 abut on surfaces of the two ends of the secondary transfer backup roller 34. Consequently, the variation of a load torque is capable of being decreased in terms of a motor that rotationally drives the secondary transfer roller 4.

In the embodiment, the opening of the hollow 41 has a length (opening width) W41 along the rotational direction D4 of the roller base 42, and the W41 is configured to be approximately 105 mm. In cases where the elastic layer 43, which is formed in a region except the hollow 41 on a peripheral surface of the secondary transfer roller 4, is positioned so as to face the intermediate transfer belt 31, the elastic layer 43 is pressed against the intermediate transfer belt 31 to form the transfer nip NP. The transfer nip NP has a length (transfer nip width) Wnp along the rotational direction D4 of the roller base 42. The Wnp is configured to be approximately 11 mm and has a relationship of:

(the opening width W41 of the hollow 41)>(the transfer nip width Wnp at the transfer nip NP).

Accordingly, in cases where the hollow 41 of the secondary transfer roller 4 faces the intermediate transfer belt 31, the transfer nip temporarily disappears.

The elastic layer 43 has a length in the rotational direction D4 of the roller base 42, and the length is configured to be approximately 495 mm. By virtue of this configuration, a recording material RM having the largest size among the ones available in the image forming apparatus 1 is capable of being wound onto the secondary transfer roller 4. Namely, the length of the elastic layer 43 is defined so as to be larger than that of the recording material having the largest size, among the available ones, in the rotational direction D4 of the roller base 42.

A transfer roller driving motor M4 is mechanically connected to the rotating shaft 421 of the secondary transfer roller 4. Furthermore, in the embodiment, a driver 12 is provided in order to drive the transfer roller driving motor M4. The driver 12 receives a command output from the controller 10 and then drives the motor M4 on the basis of the command to rotationally drive the secondary transfer roller 4 in the direction D4 that is clockwise in the page of FIG. 1, namely, in the clockwise direction relative to the direction D31 in which the intermediate transfer belt 31 is driven. The secondary transfer backup roller 34 is a driven roller not having an own driving source. The secondary transfer backup roller 34, which faces the motor-driven secondary transfer roller 4, is configured as the driven roller, so that the occurrence of slip at the transfer nip NP is prevented between the secondary transfer roller 4 and the intermediate transfer belt 31 and between the secondary transfer backup roller 34 and the intermediate transfer belt 31.

In the embodiment, an AC servomotor is used as the motor M4. The driver 12 is capable of controlling a position and a torque of the AC servomotor. Namely, the driver 12 has a position control circuit and a torque control circuit and is capable of selectively controlling the position and torque of the AC servomotor. The controller 10 is capable of transmitting a command pulse related to positional information, a commanded torque related to torque information, and a control switching signal to the driver 12.

The symbol E4 in FIG. 2 denotes an encoder fixed to the transfer roller driving motor M4. The encoder E4 transmits a signal corresponding to the rotation of the transfer roller driving motor M4 to the driver 12, and the driver 12 that has received the signal performs feedback control of the transfer roller driving motor M4 on the basis of the signal. A reference numeral 8 indicates a phase detecting sensor connected to an end of the rotating shaft 421 of the secondary transfer roller 4. The controller 10 is capable of receiving an output from the phase detecting sensor 8 to comprehend a rotational phase of the secondary transfer roller 4.

Among the rollers around which the intermediate transfer belt 31 is looped, the rollers 33 and 35 are positioned so as to interpose the transfer NP therebetween, and rotating shafts thereof are elastically supported by respective springs 331 and 351 to form tension rollers that adjust a tensile force of the intermediate transfer belt 31. More specifically, the rotating shaft of the tension roller 33 is elastically supported by the spring 331 that is capable of expanding and compressing in a substantially horizontal direction. By virtue of this configuration, the tension roller 33 is capable of moving for a predetermined distance in the substantially horizontal direction while the intermediate transfer belt 31 is looped around the tension roller 33.

The rotating shaft of the tension roller 35 is elastically supported by the spring 351 in a direction orthogonally intersecting a virtual plane that is in contact with the peripheral surfaces of both the driving roller 32 and the secondary transfer backup roller 34. By virtue of this configuration, the tension roller 35 is capable of moving for a predetermined distance in such a direction while the intermediate transfer belt 31 is looped around the tension roller 35. In a stationary state, the tension roller 35 is biased by the spring 351 such that the intermediate transfer belt 31 which extends between the belt driving roller 32 and the secondary transfer backup roller 34 in a tensioned state is pressed outward to be expanded.

In the secondary transfer position TR2, a surface of the secondary transfer roller 4 faces the intermediate transfer belt 31, and a load torque of the driving motor M3 that drives the belt driving roller 32 is significantly varied in conjunction with the rotation of the secondary transfer roller 4 when the surface of the secondary transfer roller 4 shifts from the elastic layer 43 to the hollow 41, to the contrary, when the surface shifts from the hollow 41 to the elastic layer 43. In cases where a high pressing force is applied between the elastic layer 43 and the intermediate transfer belt 31, the variation is especially large. Due to such a variation, the speed variation and vibration of the intermediate transfer belt 31 may occur, resulting in the temporary change in a tensile force of the belt 31.

However, in the embodiment, a pair of tension rollers 33 and 35 are disposed so as to interpose the secondary transfer position TR2 therebetween in a direction in which the intermediate transfer belt 31 extends. The rotating shafts of the tension rollers 33 and 35 are moved, and therefore the tension rollers 33 and 35 function so as to counteract the variation of the tensile force. Accordingly, the speed variation and vibration of the intermediate transfer belt 31 in the secondary transfer position TR2 is prevented from affecting the primary transfer position TR1 corresponding to each of the image forming stations 2Y, 2M, 2C, and 2K. The speed variation and vibration of the intermediate transfer belt 31 in the primary transfer position TR1 distorts a toner image that is transferred from the image forming station, resulting in reduced image quality. However, in the embodiment, such an adverse effect on the image formation is preliminarily prevented.

Each of the tension rollers 33 and 35 abuts on an inner surface of the intermediate transfer belt 31, in other words, abuts on a reverse surface of the intermediate transfer belt 31, the reverse surface being opposite to a surface on which an image is carried. Such a configuration is employed for the following reason. Because the tension rollers 33 and 35 abut on the surface opposite to the surface on which image is carried, the tension rollers 33 and 35 do not distort a toner image which is carried by the intermediate transfer belt 31, and furthermore the tension rollers 33 and 35 are not soiled by toner or the like that residually adheres to the intermediate transfer belt 31. For the purpose of increasing an efficiency at which the tension rollers adjust a tensile force, an effective configuration includes a large winding angle of the intermediate transfer belt 31. Unfortunately, in the case of attempts in which the tension rollers are made to abut on the surface on which the image is carried and in which the winding angle is made to be large, the surface of the intermediate transfer belt 31 is required to have a large negative curvature, resulting in a fear of an effect on a toner image and also resulting in a structural problem. For the above reason, the tension rollers 33 and 35 are configured so as to abut on the reverse surface of the intermediate transfer belt 31.

In the embodiment, the belt driving roller 32 and the tension roller 33 are disposed such that a surface of the intermediate transfer belt 31 takes a substantially horizontal position between the downstream side from the tension roller 33 and the upstream side from the belt driving roller 32 in a belt driving direction D31. Each of the primary transfer positions TR1 in the image forming stations is configured so as to be positioned in the same plane that is formed by a surface of the intermediate transfer belt 31 (more specifically, a lower surface to which a toner image is transferred). Furthermore, the rotating shaft of the tension roller 33 is configured so as to move in a substantially horizontal direction. Accordingly, even though the tension roller 33 moves to absorb the speed variation and vibration, the surface of the intermediate transfer belt 31 is kept in a horizontal position, so that the effect on image formation is capable of being minimally suppressed. Meanwhile, although it is not indispensable that the intermediate transfer belt 31 is in a horizontal position in the vicinity of the image forming stations, it is desirable that a direction in which the belt 31 is driven is at least the same as or substantially the same as a direction in which the tension roller 33 moves.

Because the belt driving roller 32 is disposed between the tension roller 35 and the primary transfer position TR1, a direction in which the tension roller 35 moves is free from the image formation. Accordingly, the tension roller 35 is configured so as to move in a direction orthogonally intersecting a virtual plane that is in contact with the peripheral surfaces of both the driving roller 32 and the secondary transfer backup roller 34, so that the speed variation and vibration of the intermediate transfer belt 31 is capable of being most effectively decreased.

A cleaner unit 39 is disposed in the vicinity of the tension roller 33 around which the intermediate transfer belt 31 is looped, and the cleaner unit 39 is capable of being separated from and to abutting on a surface of the intermediate transfer belt 31. The cleaner unit 39 scrapes residual toner on the surface of the intermediate transfer belt 31, thereby cleaning the intermediate transfer belt 31. The cleaner unit 39 is integrally supported with the rotating shaft of the tension roller 33 supported by the spring 331 and changes the position thereof in conjunction with the positional change of the tension roller 33. Accordingly, relative position between the cleaner unit 39 and the intermediate transfer belt 31 is not varied.

Figure 4:
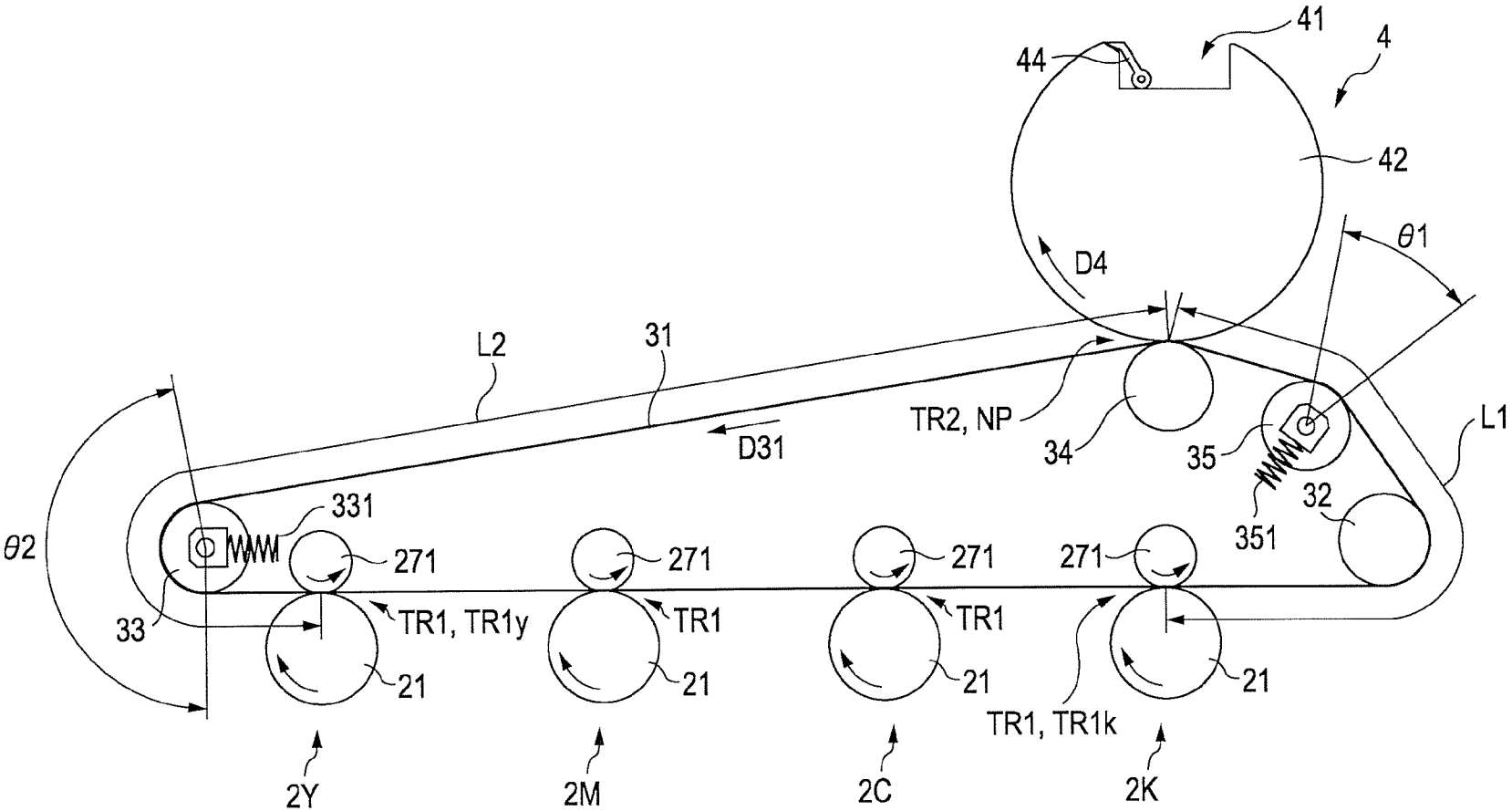
FIG. 4 illustrates arrangement of a tension roller in more detail.

FIG. 4 illustrates the positions of the tension rollers more in detail. In the embodiment, in order to enhance the absorption effect on the variation in the two tension rollers 33 and 35, the following inventiveness is employed with respect to the placement of the tension rollers, and the positions thereof will be described first of all.

In the embodiment, the belt driving roller 32 is disposed out of a route that is from the tension roller 35 in the upstream side through the secondary transfer position TR2 to tension roller 33 in the downstream side, in the direction D31 in which the intermediate transfer belt 31 is driven. By virtue of this configuration, the tension rollers are capable of separating a driving force that is transmitted from the transfer roller driving motor M4 through the secondary transfer roller 4 to the intermediate transfer belt 31 from a driving force that is transmitted from the belt driving motor M3 through the belt driving roller 32 to the intermediate transfer belt 31, thereby precluding interference between the two driving forces.

In the embodiment, a length of the intermediate transfer belt 31 from the secondary transfer position TR2 to a primary transfer position TR1*k* is defined in the direction D31 in which the intermediate transfer belt 31 is driven, and such a length is represented by a note L1, the primary transfer position TR1*k* corresponding to the image forming station 2K that is positioned in the most downstream side among the image forming stations in the direction D31 in which the intermediate transfer belt 31 is driven. Furthermore, a length of the intermediate transfer belt 31 from the secondary transfer position TR2 to a primary transfer position TR1*y* is defined, and such a length is represented by a note L2, the primary transfer position TR1*y* corresponding to the image forming station 2Y that is positioned in the most upstream side among the image forming stations in the direction D31 in which the intermediate transfer belt 31 is driven. In this case, each of the rollers 32 to 35 is positioned so as to satisfy a relationship represented by:

$$L1<L2 \quad \text{(formula 1).}$$

Owing to such a configuration, the following advantageous effect is capable of being obtained. The tension roller 35 and the belt driving roller 32 are disposed between the secondary transfer position TR2 and the primary transfer position TR1*k*, and the tension roller 35 and the belt driving roller 32 are capable of absorbing the speed variation and vibration of the intermediate transfer belt 31, the variation and vibration being generated in the secondary transfer position TR2. The tension roller 35 changes its own position, thereby absorbing the variation. In addition, in the belt driving roller 32, a driving torque of the belt driving motor M3 suppresses the variation. Because the tension roller 35 and the belt driving roller 32 block transmission of the variation from the secondary transfer position TR2 to the primary transfer position TR1*k* in two stages in this manner, the effect on the primary transfer position TR1*k* is capable of being almost certainly suppressed even though a length L1 of the intermediate transfer belt 31 in this region is short.

On the other hand, only the tension roller 33 is disposed between the secondary transfer position TR2 and the primary transfer position TR1*y*. Accordingly, the length L2 of the intermediate transfer belt 31 in this region is configured to be large, so that transmission of the variation from the secondary transfer position TR2 to the primary transfer position TR1*y* is capable of being more decreased owing to the flexibility and elasticity of the belt itself.

A second inventiveness for the enhancement of the effect that the tension rollers 33 and 35 absorb the variation is a relationship between an amount in which the intermediate transfer roller 31 is looped around each tension roller and the strength of the springs.

Figure 5:
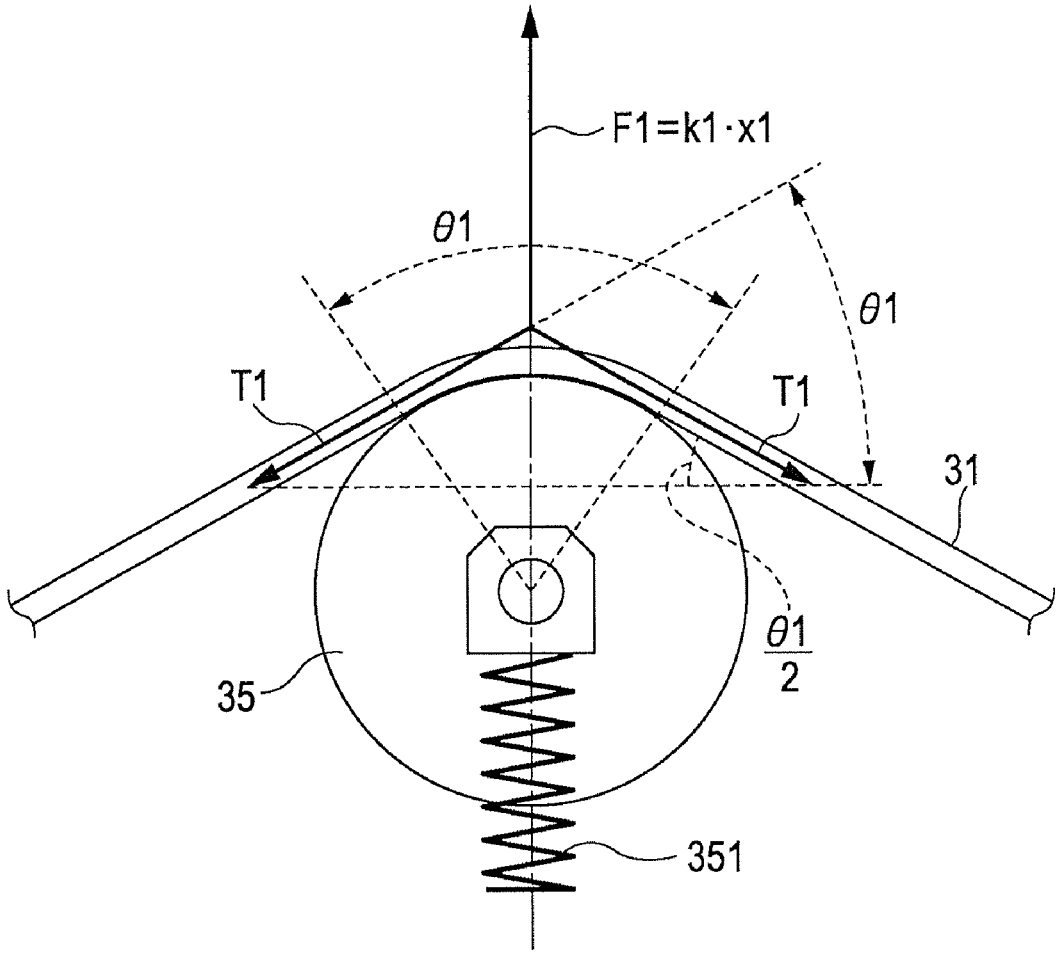
FIG. 5 illustrates the operation of the tension roller.

FIG. 5 illustrates the operation of the tension roller. There is assumed that the spring 351 expands and compresses to change the position of the tension roller 35 by x1 with the result that a tensile force of the intermediate transfer belt 31 is changed in a change amount T1. In this case, there is provided that a spring constant of the spring 351 is defined as k1 and that an angle at which the intermediate transfer belt 31 is looped around the tension roller 35 is defined as θ1. A force F1 generated by the action of the spring 351 is represented by:

$$F1=k1\cdot x1 \quad \text{(formula 2).}$$

The force F1 is balanced with a resultant force of tension which acts in the change amount T1 in the upstream side and the downstream side from a winding portion along a surface of the intermediate transfer belt 31, and therefore, given the relationships illustrated in FIG. 5, a relationship of:

$$2T1\cdot\sin(\theta1)=F1 \quad \text{(formula 3)}$$

is obtained. Accordingly, given the formulas 2 and 3, a relationship of:

$$T1=(1/2)\cdot k1\cdot x1/[\sin(\theta1/2)] \quad \text{(formula 4)}$$

is derived.

Similarly, there is assumed that a spring constant of the spring 331 which supports the tension roller 33 is defined as k2 and that an amount of the positional change of the tension roller 331 is defined as x2 and that an angle at which the intermediate transfer belt 31 is looped around the tension roller 33 is defined as θ2. The position of the tension roller 33 is changed with the result that a tensile force of the intermediate transfer belt 31 is changed in a change amount T2, and the change amount T2 is represented by:

$$T2=(1/2)\cdot k2\cdot x2/[\sin(\theta2/2)] \quad \text{(formula 5).}$$

In cases where a provision of T1=T2 is satisfied, the changes which the two tension rollers impart to the tensile force of the intermediate transfer belt 31 counteract each other. Furthermore, the positional change of the tension roller 33 disposed in the vicinity of the primary transfer position TR1*y* has a great effect on the image formation, and therefore in order to decrease such an effect, the positional change amount x2 of the tension roller 33 is desirably smaller than the positional change amount x1 of the tension roller 35 which is disposed such that the belt driving roller 32 is positioned between the primary transfer position TR1*k* and the tension roller 35. Given such a provision and the formulas 4 and 5, a relationship of:

$$k1/\sin(\theta1/2)<k2/\sin(\theta2/2) \quad \text{(formula 6)}$$

is obtained as a more desirable provision.

In cases where the relationship of the formula 6 is obtained in the angles θ1 and θ2, at which the intermediate transfer belt 31 is looped around the respective tension rollers 35 and 33, and in the spring constants k1 and k2 of the respective springs 351 and 331 that support the respective tension rollers 35 and 33, the tension roller 35 undergoes the relatively large positional change due to the speed variation and vibration of the intermediate transfer belt 31 in the secondary transfer position TR2. However, because the intermediate transfer belt 31 is looped around the belt driving roller 32 between the winding position of the tension roller 35 and the primary transfer position TR1*k*, the positional change of the tension roller 35 does not affect the image formation. On the other hand, the positional change of the tension roller 33 that is disposed in the vicinity of the primary transfer position TR1*y* is reduced, resulting in suppressing an effect on the image formation in a minimum extent.

The belt driving roller 32 abuts on the intermediate transfer belt 31 at a position that is in the downstream side relative to the primary transfer position TR1*k* located in the most downstream side and that is in the upstream side relative to a position in which the tension roller 35 abuts on the intermediate transfer belt 31, in a direction D31 in which the intermediate transfer belt 31 is driven. Such a configuration is employed for the reason that the positional change of the tension roller 35 is not allowed to influence the primary transfer position TR1*k*, and the following effect is also expected. Namely, by virtue of this configuration, the belt driving roller 32 makes the intermediate transfer belt 31 be in a continuous tensioned state with a substantially constant torque, the intermediate transfer belt 31 passing the primary transfer position TR1 corresponding to each of the image forming stations. Accordingly, the loosening of the intermediate transfer belt 31 is excluded in each of the primary transfer positions TR1, and therefore the toner image that is transferred from each of the image forming stations in the primary transfer position TR1 is not distorted. Furthermore, because the loosing is not caused, a distance between the individual primary transfer positions TR1 along round of the intermediate transfer belt 31 is not varied, so that a positional variation is capable of being prevented while toner image of each color is applied.

Representative examples of numeral values in the embodiment are as follows:

L1: 476 mm;
L2: 848 mm;
θ1: 42.7°;
θ2: 168.9°;
k1: 1.0 N/mm; and
k2: 5.9 N/mm.

In this case, relationships of:

$$k1/\sin(\theta 1/2) \approx 2.7 \text{ N/mm; and}$$

$$k2/\sin(\theta 2/2) \approx 5.9 \text{ N/mm}$$

are obtained, and the relationships of the formula 1 and 6 are satisfied.

Figure 6:
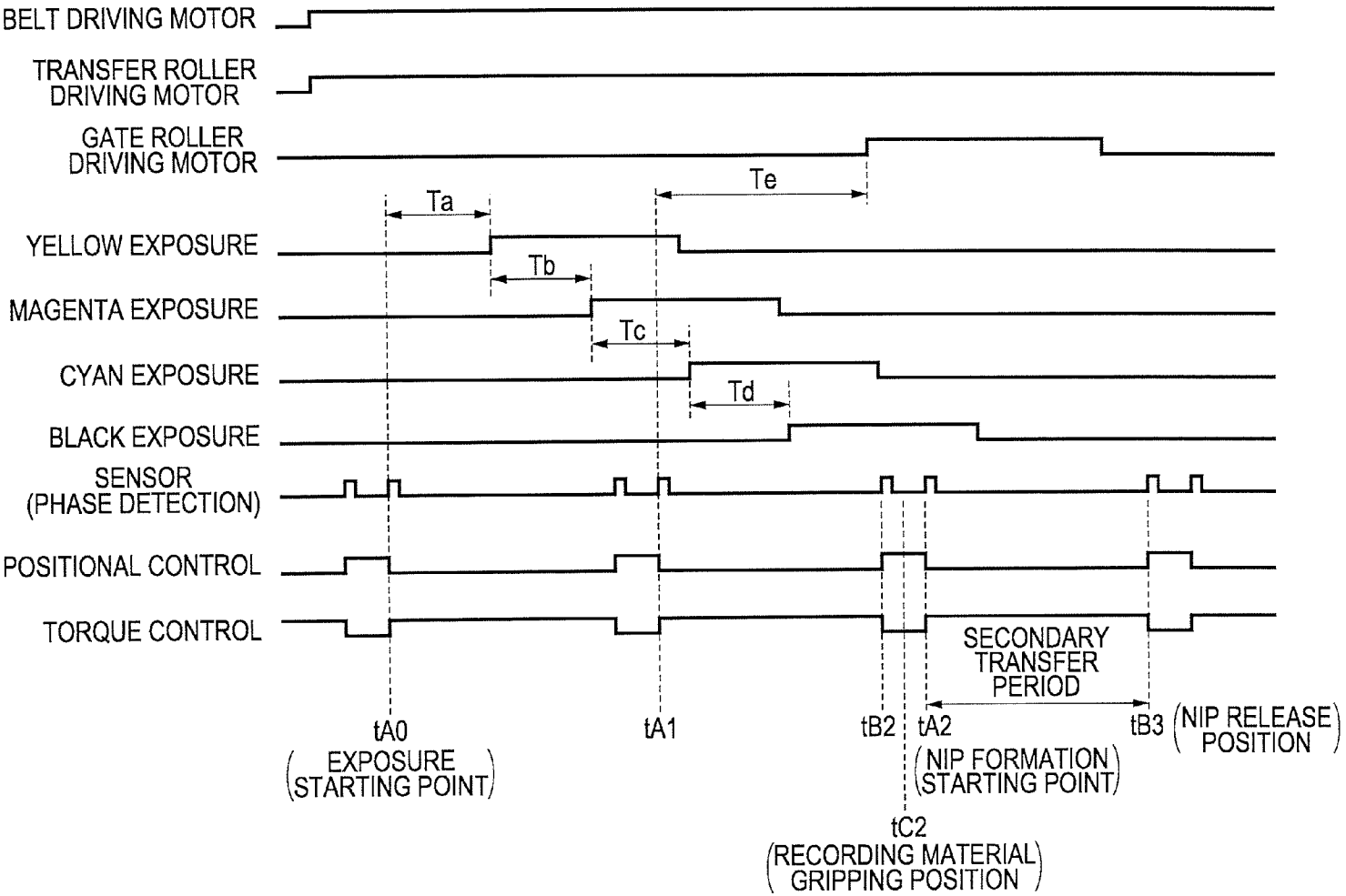
FIG. 6 is timing chart illustrating an example of the operation of the image forming apparatus illustrated in FIG. 1.
Figure 7A:
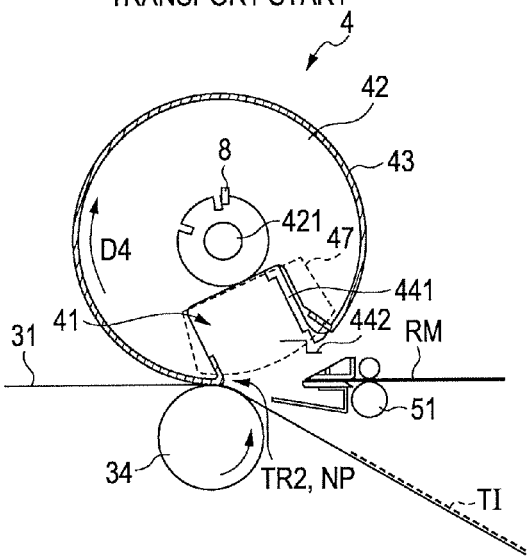
FIG. 7A is a first view schematically illustrating the operation of the image forming apparatus illustrated in FIG. 1.
Figure 7B:
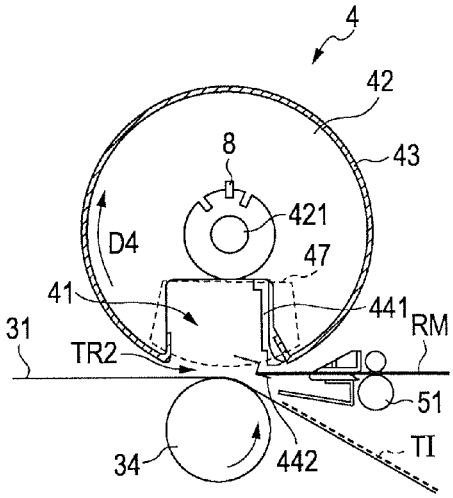
FIG. 7B is the first view schematically illustrating the operation of the image forming apparatus illustrated in FIG. 1.
Figure 7C:
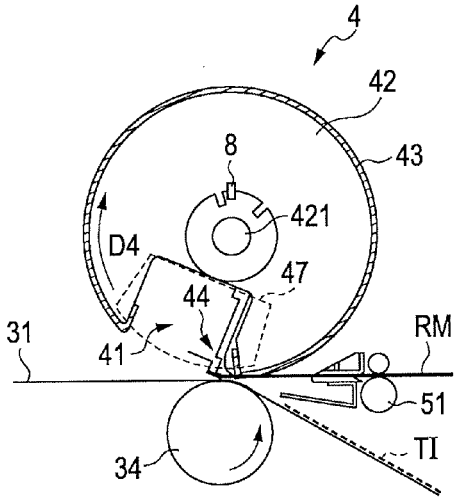
FIG. 7C is the first view schematically illustrating the operation of the image forming apparatus illustrated in FIG. 1.
Figure 7D:
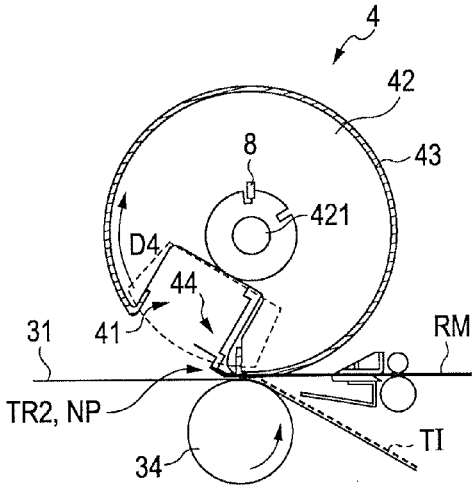
FIG. 7D is the first view schematically illustrating the operation of the image forming apparatus illustrated in FIG. 1.

The operation of the image forming apparatus 1 having the above configuration will be described with reference to FIGS. 6 to 8. FIG. 6 is timing chart illustrating an example of the operation of the image forming apparatus 1 illustrated in FIG. 1. FIGS. 7A to 8B schematically illustrate the operation of the image forming apparatus 1 illustrated in FIG. 1. In the image forming apparatus 1, an image forming command for formation of a color image is transmitted from an external apparatus such as a host computer to the controller 10, and then the controller 10 controls each section of the image forming apparatus 1 on the basis of a program stored in a memory (not illustrated). First, the belt driving motor M3 and the transfer roller driving motor M4 are operated to drive the intermediate transfer belt 31 and the secondary transfer roller 4, respectively.

In the secondary transfer position TR2, a surface of the secondary transfer roller 4 faces the intermediate transfer belt 31, and in cases where such a facing surface of the secondary transfer roller 4 shifts from a cylindrical peripheral surface having an elastic layer 43 to the hollow 41, and in cases where such a facing surface of the secondary transfer roller 4 shifts from the hollow 41 to the elastic layer 43, the phase detecting sensor 8 (see, FIG. 2) included in the secondary transfer roller 4 temporarily outputs a signal at an H level. The driver 12 controls the driving of the secondary transfer roller 4, and the controller 10 alternately switches a state of the control between positional control and torque control on the basis of the output of the signal at such a level. More specifically, in cases where the hollow 41 of the secondary transfer roller 4 faces the intermediate transfer belt 31, the positional control is performed, and in cases where the elastic layer 43 faces the intermediate transfer belt 31 to form the transfer nip NP, the torque control is performed. The belt driving motor M3 constantly undergoes positional control, so that the intermediate transfer belt 31 circulates at a predetermined speed.

At timing tA0, the output from the phase detecting sensor 8 is changed, and a surface of the secondary transfer roller 4 shifts from the hollow 41 to the elastic layer 43 to form the transfer nip NP in the secondary transfer position TR2. At this time, the controller 10 switches a state of the drive control performed by the driver 12 to the torque control on the basis of a control switching signal and then transmits a command torque to the driver 12 with the result that the secondary transfer roller 4 is subjected to the torque control. Furthermore, the timing tA0 is set as an exposure starting point, and a toner image is formed in each of the image forming stations 2Y, 2M, 2C, and 2K, thereby primarily transferring the toner image onto a surface of the intermediate transfer belt 31.

Namely, with reference to FIG. 6, the passage of a time Ta from the timing tA0 leads to the exposure unit 23 beginning latent image formation in the image forming station 2Y on the basis of each signal output from the controller 10, thereby forming a toner image with yellow toner. Furthermore, the passage of a time Tb from the beginning of the yellow exposure makes magenta exposure start, and the passage of a time Tc from the beginning of the magenta exposure makes cyan exposure start, and the passage of a time Td from the beginning of the cyan exposure makes black exposure start. The toner image of each color is formed in this manner and sequentially applied to the intermediate transfer belt 31, thereby forming a full-color toner image T1 on a surface of the intermediate transfer belt 31.

During the formation of the toner image of each color, the secondary transfer roller 4 is further rotated one revolution in the rotational direction D4, and the transfer nip NP that has been once canceled is formed again. Subsequently, a predetermined time Te passes from timing tA1, and then the controller 10 transmits a command pulse to a driver (not illustrated) that controls a gate roller driving motor (not illustrated) connected to the gate roller 51, thereby operating the gate roller driving roller. Consequently, the recording material RM begins to be transported to the secondary transfer position TR2 (see, FIG. 7A).

Furthermore, a surface of the secondary transfer roller 4 in the secondary transfer position TR2 shifts to the hollow 41 to cancel the transfer nip, and timing tB2 is defined at this point. At the timing tB2, the controller 10 switches the state of the drive control performed by the driver 12 from the torque control to the positional control on the basis of the control switching signal and transmits the command pulse to the driver 12. Then, the secondary transfer roller 4 is rotated in the rotational direction D4 to be positioned at a predetermined recording material gripping position (see, FIG. 7B). In addition, the leading end of the gripping member 442 is separated from the leading end of the gripping support member 441, and then grip of the recording material RM has been prepared. Then, the leading end of the recording material RM transported by the gate rollers 51 intrudes between the gripping member 442 and the gripping support member 441, thereby beginning paper pinch operation (see, FIG. 7B). Although a term "paper pinch operation" is used herein for convenience, the recording material RM is not limited to paper as described above.

The controller 10 transmits a gripping command to a gripper driving section (not illustrated) in synchronization with or slightly later than timing tB2. The gripper driving section that has received the gripping command is driven to move the leading end of the gripping member 442 to the gripping support member 441. Accordingly, the leading end of the recording material RM is gripped, and the paper pinch operation is finished (see, FIG. 7C). At the time that the paper pinch operation has finished, the toner image TI is positioned in the upstream side relative to the secondary transfer position TR2 in the direction D31 in which the intermediate transfer belt 31 is driven, as illustrated in FIG. 7C.

The recording material RM is transported in the rotational direction D4 in conjunction with the rotation of the secondary transfer roller 4 in this manner while the leading end thereof is gripped by the gripper 44. At timing tA2 in which the elastic layer 43 on a surface of the secondary transfer roller 4 reaches the secondary transfer position TR2 to form the transfer nip NP, the recording material RM is pinched at the transfer nip NP between the elastic layer 43 of the secondary transfer roller 4 and a surface of the intermediate transfer belt 31, thereby being transported in conjunction with the rotation of the secondary transfer roller 4 and the intermediate transfer belt 31. Accordingly, the toner image TI formed on the intermediate transfer belt 31 begins to be secondarily transferred onto the lower surface (a surface) of the recording material RM (see, FIG. 7D). Furthermore, at the timing tA2, the controller 10 switches the state of drive control performed by the driver 12 to the torque control on the basis of the control switching signal and then transmits a command torque to the driver 12 with the result that the secondary transfer roller 4 is subjected to the torque control.

Figure 8A:
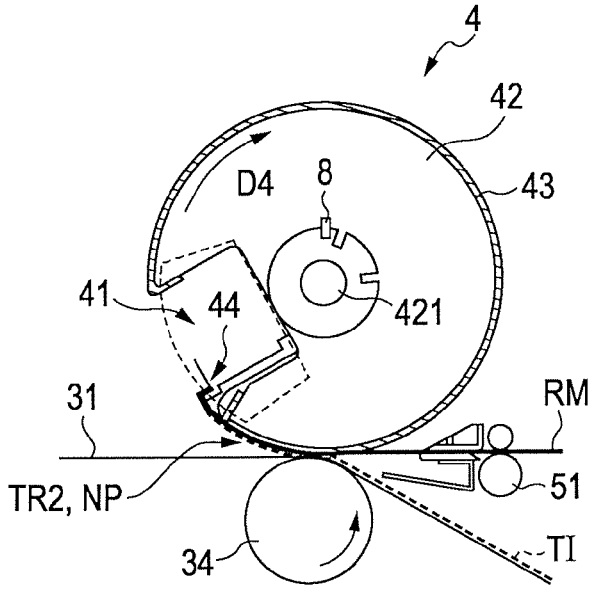
FIG. 8A is a second view schematically illustrating the operation of the image forming apparatus illustrated in FIG. 1.
Figure 8B:
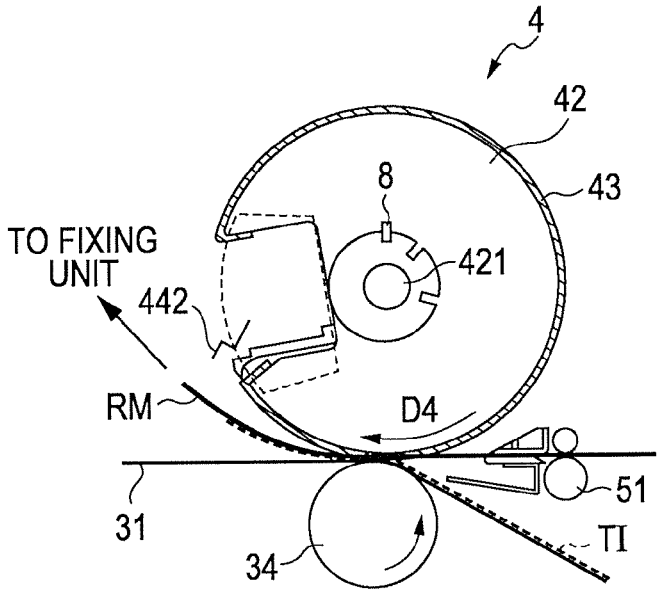
FIG. 8B is the second view schematically illustrating the operation of the image forming apparatus illustrated in FIG. 1.

The secondary transfer roller 4 is rotated in the rotational direction D4 while being subjected to the torque control in this manner, and therefore the recording material RM is transported through the transfer nip NP while the leading end thereof is gripped by the gripper 44, thereby proceeding with the secondary transfer of the toner image TI (see, FIG. 8A). The gripper 44 moves to a position in the vicinity of the upstream end of the transport roller 7 (an end on the right side in FIG. 1), and then the leading end of the recording material RM gripped by the gripper 44 is sufficiently separated from the intermediate transfer belt 31 and is transported to a transport entrance of the transport roller 7. At timing that the gripper 44 moves to the position in the vicinity of the upstream end of the transport roller 7 as illustrated in FIG. 8B, the controller 10 transmits a release command to the gripper driving section, thereby separating the leading end of the gripping member 442 from the leading end of the gripping support member 441 to release the grip on the recording material RM. Accordingly, the leading end of the recording material RM is certainly transported to the transport roller 7 without adhering to a surface of the intermediate transfer belt 31. Subsequently, the fixing unit disposed in a downstream side relative to the transport roller 7 fixes the color toner image TI to the recording material RM. Meanwhile, after the release of the leading end of the recording material RM, the leading end of the recording material RM is transported toward the fixing unit along the transport path PT, and the rear of the recording material RM undergoes secondary transfer processing at the transfer nip NP while being transported by being pinched between the elastic layer 43 of the secondary transfer roller 4 and intermediate transfer belt 31.

As described in the embodiment, the two tension rollers 33 and 35 are disposed to abut on the intermediate transfer belt 31 such that the secondary transfer position TR2, in which the transfer roller 4 faces the intermediate transfer belt 31, is disposed between the tension rollers 33 and 35, the transfer roller 4 partially having the hollow 41 on the peripheral surface thereof. In cases where a surface of the secondary transfer roller 4 shifts from the hollow 41 to the elastic layer 43 in the secondary transfer position TR2, to the contrary, in the case of the shift from the elastic layer 43 to the hollow 41, the speed variation and vibration of the intermediate transfer belt 31 are generated due to the variation of a load torque. However, such a speed variation and vibration are suppressed by the two tension rollers 33 and 35 having the configuration of the embodiment, thereby preliminary preventing the transmission of the speed variation and vibration to the primary transfer position TR1. Accordingly, a toner image that is formed by each of the image forming stations 2Y, 2M, 2C, and 2K in the primary transport position TR1 is not distorted by the speed variation and the like, so that a high-quality image is capable of being stably formed.

Furthermore, in the embodiment, the belt driving roller 32 is disposed out of a route between the two tension rollers that interpose the secondary transfer position TR2 therebetween, more specifically, is disposed in the further upstream side relative to the tension roller 35 positioned in the upstream side among the two tension rollers in the direction D31 in which the intermediate transfer belt 31 is driven, and is disposed in the further downstream side relative to the primary transfer position TR1*k* corresponding to the image forming station 2K which is positioned in the most downstream side among a plurality of the image forming stations. The belt driving roller 32 is connected to the belt driving motor M3 and therefore is less affected by speed variation resulting from external factors. Such a belt driving roller 32 is disposed between the tension roller 35 and the primary transfer position TR1*k*, thereby being able to efficiently suppress the transmission of the speed variation or the like of the intermediate transfer belt 31 in the secondary transfer position TR2 to the primary transfer position TR1*k*.

On the other hand, an effect that the belt driving roller absorbs the variation has limitation in a downstream side from the secondary transfer position TR2. Accordingly, in the embodiment, a distance along a route in which the belt is driven is configured to be large to enhance an effect that the variation is absorbed by the flexibility and elasticity of the belt itself, thereby suppressing the transmission of the speed variation or the like to the primary transfer position TR1*y* corresponding to the image forming station 2Y positioned in the most upstream side. Furthermore, a direction in which the position of the tension roller 33 is changed is configured to be the same as or substantially the same as a direction in which the intermediate transfer belt 31 extends in the primary transfer position, such as the primary transfer position TR1*y*, thereby preventing the positional change of the tension roller 33 from adversely influencing the image formation.

Furthermore, an angle at which the intermediate transfer belt 31 is looped around each of the two tension rollers and a spring constant of a spring that supports each of the tension rollers are configured so as to satisfy the relationship represented by the formula 6, thereby being able to enhance the variation absorption effect.

An image forming apparatus according to a second embodiment of the invention will be described with reference to FIGS. 9 and 10.

Figure 9:
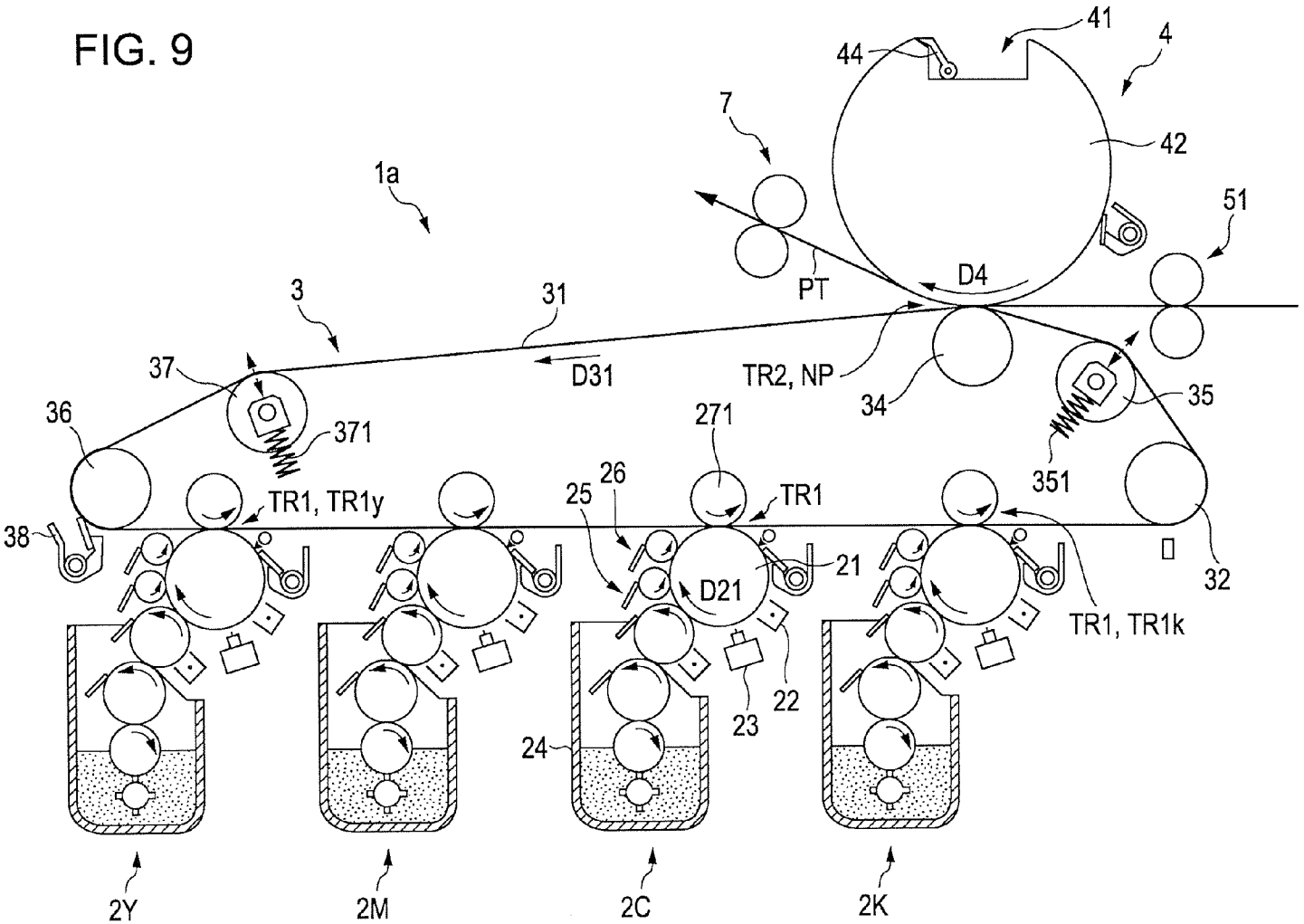
FIG. 9 illustrates an image forming apparatus according to a second embodiment of the invention.
Figure 10:
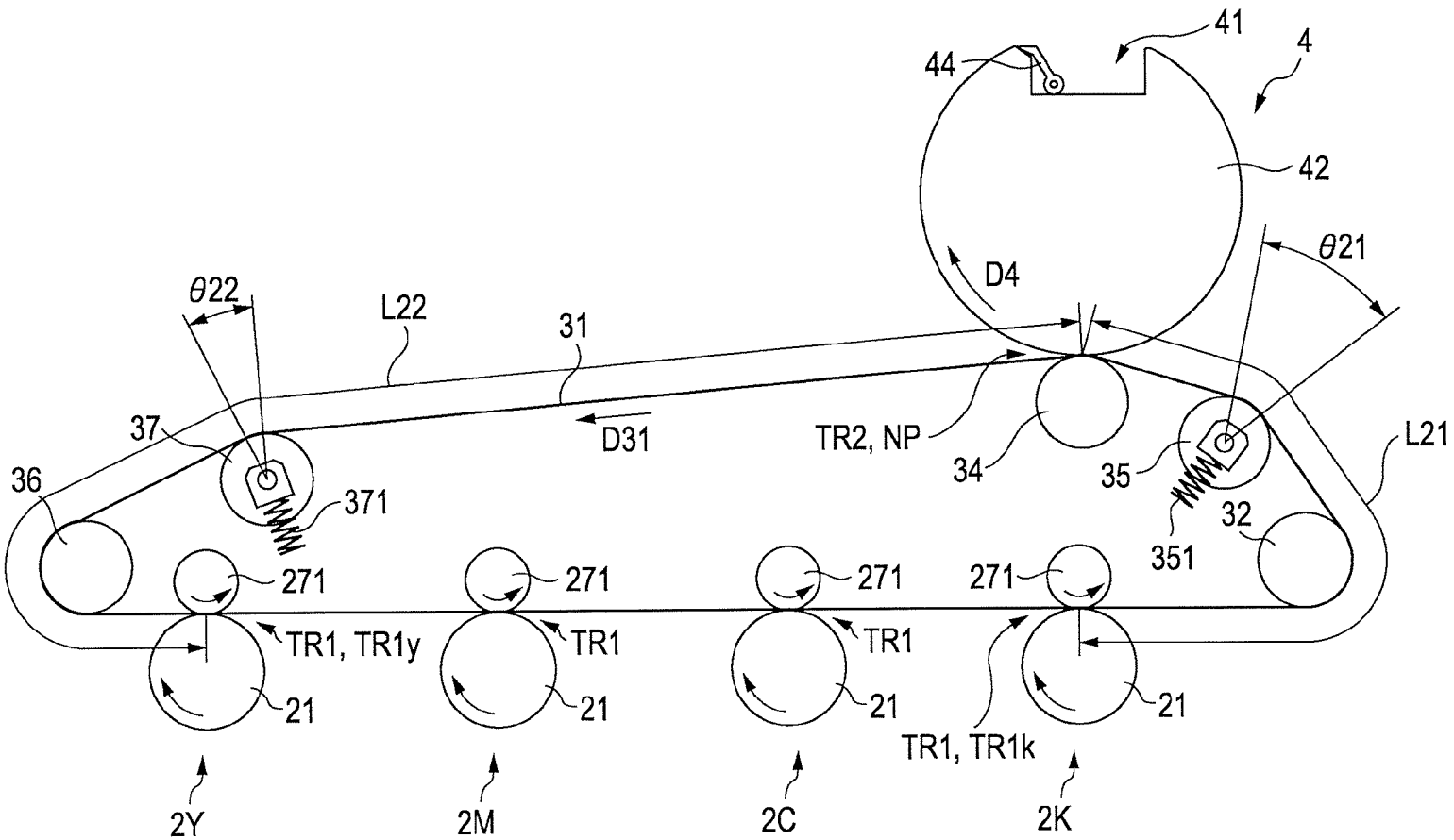
FIG. 10 illustrates arrangement of rollers according to the second embodiment in more detail.

FIG. 9 illustrates the image forming apparatus according to the second embodiment of the invention. FIG. 10 illustrates arrangement of rollers according to the second embodiment in more detail. In the first embodiment, the tension roller 33 is disposed at a position in the vicinity of an upstream side relative to the image forming station 2Y positioned in the most upstream side. On the other hand, in the image forming apparatus 1*a* according to the second embodiment illustrated in FIG. 9, a driven roller 36 is disposed at a position in the vicinity of the upstream side relative to the image forming station 2Y positioned in the most upstream side, the driven roller 36 has a rotating shaft that does not travel. Furthermore, a tension roller 37 is disposed between the secondary transfer position TR2 and the driven roller 36. In other words, the driven roller 36 is additionally disposed between the tension roller 37 and the primary transfer position TR1*y* corresponding to the image forming station 2Y in the most upstream side in the direction D31 in which the intermediate transfer belt 31 is driven, the tension roller 37 being disposed in a downstream side relative to the secondary transfer position TR2.

The driven roller 36 is disposed such that a surface of the intermediate transfer belt 31 is in a substantially horizontal position between the downstream side relative to the driven roller 36 and the upstream side relative to the belt driving roller 32 in the direction D31 in which the belt is driven. The primary transfer position TR1 of each of the image forming stations is configured so as to be positioned in the same plane that is formed by a surface of the intermediate transfer belt 31 (more specifically, a lower surface onto which a toner image is transferred).

In addition, the cleaner unit 38 is disposed in the vicinity of a position in which the intermediate transfer belt 31 is looped around the driven roller 36. Except these configurations, the other configurations of the second embodiment are the same as those of the first embodiment. Accordingly, the same components as those of the first embodiment are denoted by the same reference numerals and notes, and the description thereof will be omitted herein.

Also with such a configuration, as is the case with the first embodiment, the two tension rollers 35 and 37 are capable of absorbing the variation, thereby preventing that the speed variation of the intermediate transfer belt 31 in the transfer position TR2 affects the primary transfer position TR1 to distort the image formation. Furthermore, because the primary transfer position TR1 corresponding to each of the image forming stations, such as the image forming station 2Y, is positioned between the two rollers 32 and 36 each having the rotating shaft of which the position is not changed, a position of the intermediate transfer belt 31 is not changed in each of the primary transfer positions TR1. Accordingly, an image is capable of being stably formed in each of the image forming stations. Furthermore, the driven roller 36 is disposed between the tension roller 37 and the primary transfer position TR1*y* corresponding to the image forming station 2Y positioned in the most upstream side, thereby enabling the positional change of the tension roller 37 to be more certainly prevented from affecting the primary transfer position TR1*y*.

Preferably, the relationships represented by the formulas 1 and 6 are obtained also in the second embodiment. Namely, with reference to FIG. 10, a length of the intermediate transfer belt 31 from the secondary transfer position TR2 to the primary transfer position TR1*k* is represented by a note L21 in the direction D31 in which the intermediate transfer belt 31 is driven, the primary transfer position TR1*k* corresponding to the image forming station 2K that is positioned in the most downstream side among the image forming stations in the direction D31. In addition, a length of the intermediate transfer belt 31 from the secondary transfer position TR2 to the primary transfer position TR1*y* is represented by the note L22, the primary transfer position TR1*y* corresponding to the image forming station 2Y that is positioned in the most upstream side among the image forming stations in the direction D31 in which the intermediate transfer belt 31 is driven. In this case, the second embodiment is configured so as to obtain a relationship represented by:

$$L21<L22 \quad \text{(formula 1a).}$$

In addition, there is provided that a spring constant of the spring 351 is defined as k21 and that an angle at which the intermediate transfer belt 31 is looped around the tension roller 35 is defined as θ21. Furthermore, there is provided that a spring constant of the spring 371 that supports the tension roller 37 is defined as k22 and that an angle at which the intermediate transfer belt 31 is looped around the tension roller 37 is defined as θ22. The second embodiment is configured so as to obtain a relationship represented by:

$$k21/\sin(\theta 21/2)<k22/\sin(\theta 22/2) \quad \text{(formula 6a).}$$

Specific examples of numeral values in the embodiment are as follows:

L21: 500 mm;
L22: 870 mm;
θ21: 39.7°;
θ22: 21.6°;
k21: 1.0 N/mm; and
k22: 1.0 N/mm.

In this case, relationships of:

$$k21/\sin(\theta 21/2)\approx 2.9 \text{ N/mm; and}$$

$$k22/\sin(\theta 22/2)\approx 5.3 \text{ N/mm}$$

are obtained, and the relationships of the formula 1a and 6a are satisfied.

As described in the embodiments, the intermediate transfer belt 31 functions as an image carrier according to an aspect of the invention. Furthermore, the belt driving roller 32, the secondary transfer backup roller 34, and the belt driving motor M3 respectively function as a driving roller, a roller, and a first driving source according to an aspect of the invention. The tension roller 35 in the first and second embodiments functions as a first tension roller according to an aspect of the invention, and the spring 351 that supports the tension roller 35 functions as a first spring. On the other hand, the tension roller 33 in the first embodiment and the tension roller 37 in the second embodiment each function as a second tension roller according to an aspect of the invention, and the springs 331 and 371 that support the respective tension rollers 33 and 37 each function as a second spring.

Furthermore, in each of the embodiments, the secondary transfer roller 4 and the transfer roller driving motor M4 respectively function as a transfer roller and a second driving source according to an aspect of the invention. Furthermore, the hollow 41 formed on the secondary transfer roller 4 corresponds to a hollow portion according to an aspect of the invention. Moreover, the elastic layer 43 and the gripper 44 which are disposed on a peripheral surface of the secondary transfer roller 4 respectively function as an elastic layer and a gripper according to an aspect of the invention.

Furthermore, in each of the embodiments, each of the image forming stations 2Y, 2M, 2C, and 2K functions as a image forming section according to an aspect of the invention. Especially, the black image forming station 2K positioned in the most downstream side functions as a second image forming section according to an aspect of the invention. Moreover, the primary transfer position TR1 corresponding to each of the image forming stations corresponds to an image forming position according to an aspect of the invention.

Furthermore, in each of the embodiments, the intermediate transfer belt 31, the belt driving roller 32, the secondary transfer backup roller 34, the secondary transfer roller 4, and the tension rollers 33 and 35 integrally form a transfer apparatus according to an aspect of the invention. Each of these components may be configured as a transfer unit that is removable from an apparatus body. In this instance, the transfer unit corresponds to the transfer apparatus according to an aspect of the invention. In this case, the transfer unit may not include a driving source that drives the transfer roller and the driving roller, and for example, the transfer unit is mounted to the apparatus body with the result that a motor fixed to the apparatus body engages with the transfer roller and the driving roller to function as a driving source.

The invention is not limited to the embodiments, and various changes other than the embodiments may be made without departing from the scope of the invention. For example, although the four image forming stations are positioned in line in a direction in which the intermediate transfer belt 31 extends in each of the embodiments, the number and position of the image forming station are not limited to this configuration. For example, in cases where the invention is applied to an image forming apparatus having only a single image forming station, the relationship represented by the formula 1 may be applied with being changed as follows. Namely, measured from an image forming position corresponding to the image forming station, a length of the intermediate transfer belt 31 to the transfer nip in the upstream side in a direction in which the intermediate transfer belt 31 circulates may be configured to be larger than that in the downstream side.

In each of the embodiments, the image forming apparatus employs a liquid development technique, and developer in which toner is dispersed into a liquid carrier is used. However, the invention is not limited to the embodiment and may be variously applied. Namely, the invention is capable of being generally applied to an image forming apparatus and transfer apparatus in which a transfer roller having a peripheral feature on which a cylindrical peripheral surface is partially hollowed abuts on the intermediate transfer belt as illustrated in FIG. 1, regardless of a development technique.

Furthermore, the invention is capable of being also applied to an apparatus including a transfer roller not having a gripping mechanism. For example, in an apparatus in which a sheet-like elastic body is wound onto a surface of the transfer roller to form an elastic surface layer, a hollow portion is required to be formed on a peripheral surface of the transfer roller to fix an end of the sheet-like elastic body. The invention is capable of being also applied to an apparatus having such a configuration but not having the gripping mechanism.

The entire disclosure of Japanese Patent Application No: 2009-192180, filed Aug. 21, 2009 is expressly incorporated by reference herein.

What is claimed is:

1. An image forming apparatus comprising:

an image carrier that has a belt-like shape and carries an image;

an image forming section that forms the image on the image carrier;

a driving roller around which the image carrier is looped, the driving roller being rotationally driven by a first driving source to drive the image carrier;

a roller around which the image carrier is looped;

a transfer roller having a partially hollow peripheral surface and being rotationally driven by a second driving source, the transfer roller abutting on the image carrier to form a transfer nip at a position at which the image carrier is looped around the roller;

a first tension roller that abuts on the image carrier between a position of the driving roller and a position of the roller to adjust a tensile force of the image carrier; and a second tension roller that abuts on the image carrier to adjust a tensile force of the image carrier, the second tension roller abutting on the image carrier on an abutting position opposite to that of the first tension roller so as to interpose the transfer nip between the first and second tension rollers.

2. The image forming apparatus according to claim 1, wherein the first tension roller and the second tension roller abut on a surface of the image carrier, the surface being opposite to a surface on which the image is carried.

3. The image forming apparatus according to claim 1, wherein the image forming section forms the image on the image carrier, and then the driving roller drives the image carrier, and subsequently the transfer nip is formed on the driven image carrier.

4. The image forming apparatus according to claim 1, further comprising a second image forming section that forms a second image on the image carrier having the image that has been formed in the image forming section, wherein a length of the image carrier from the transfer nip to a position in which the image forming section forms the image on the image carrier is larger than a length of the image carrier from a position in which the second image forming section forms the second image on the image carrier to the transfer nip, in a direction in which the image carrier is driven.

5. The image forming apparatus according to claim 4, wherein the first tension roller is supported by a first spring having a spring constant k1, and the second tension roller is supported by a second spring having a spring constant k2, wherein, provided that an angle at which the image carrier is looped around the first tension roller is defined as θ1 and that an angle at which the image carrier is looped around the second tension roller is defined as θ2, a relationship represented by a formula:

$$k1/\sin(\theta 1/2)<k2/\sin(\theta 2/2)$$

is obtained.

6. The image forming apparatus according to claim 1, wherein an elastic layer is provided on a peripheral surface of the transfer roller.

7. The image forming apparatus according to claim 1, wherein a gripper is provided at the hollow portion, the gripper being configured to grip a recording material to which the image is transferred.

8. A transfer apparatus comprising:

a transfer belt to which an image is transferred;

a driving roller around which the transfer belt is looped, the driving roller being rotationally driven by a first driving source;

a roller around which the transfer belt is looped;

a transfer roller having a partially hollow cylindrical peripheral surface and being rotationally driven by a second driving source, the transfer roller abutting on the transfer belt to form a transfer nip at a position at which the transfer belt is looped around the roller;

a first tension roller that abuts on the transfer belt between a position of the driving roller and a position of the roller to adjust a tensile force of the transfer belt; and a second tension roller that abuts on the transfer belt to adjust a tensile force of the transfer belt, the second tension roller abutting on the transfer belt on an abutting position opposite to that of the first tension roller so as to interpose the transfer nip between the first and second tension rollers.

* * * * *